US005197900A

United States Patent [19]

Ellis et al.

[11] Patent Number: 5,197,900

[45] Date of Patent: Mar. 30, 1993

[54] ENERGY TRANSMISSION CABLE CONNECTOR WITH INTERCHANGEABLE LOCKING MECHANISMS

[75] Inventors: J. Scott Ellis; Keith R. Carver, both of Milpitas, Calif.

[73] Assignee: Icontec, Inc., Milpitas, Calif.

[21] Appl. No.: 631,879

[22] Filed: Dec. 21, 1990

[51] Int. Cl.[5] ..... H01R 13/627

[52] U.S. Cl. ..... 439/352; 439/350; 439/359

[58] Field of Search ..... 439/350-353, 439/357, 358, 359, 607, 610, 362, 365

[56] References Cited

U.S. PATENT DOCUMENTS

| | | | |
|---|---|---|---|
| 3,718,887 | 2/1973 | Solomon et al. | 439/362 |
| 3,744,128 | 7/1973 | Fisher et al. | 29/629 |
| 3,871,732 | 3/1975 | Appleton | 439/356 |
| 4,105,275 | 8/1978 | Dixon et al. | 439/358 |
| 4,109,989 | 8/1978 | Snyder, Jr. et al. | 439/357 |
| 4,120,553 | 10/1978 | Muz | 439/352 |
| 4,188,086 | 2/1980 | Inouye et al. | 339/176 MF |
| 4,460,230 | 7/1984 | McKee et al. | 439/359 |
| 4,577,919 | 3/1986 | Waters | 439/362 |
| 4,597,624 | 7/1986 | Lax et al. | 339/143 R |
| 4,634,203 | 1/1987 | Noyes | 439/359 |
| 4,641,902 | 2/1987 | Fusselman | 439/350 |
| 4,702,542 | 10/1987 | Noyes | 439/347 |
| 4,726,783 | 2/1988 | Nakazawa et al. | 439/350 |
| 4,787,860 | 11/1988 | Bender | 439/358 |
| 4,830,629 | 5/1989 | Yoshimura | 439/610 |
| 4,842,542 | 6/1989 | Davis | 439/357 |
| 4,873,614 | 10/1989 | Lichtensperger | 439/358 |
| 4,961,711 | 10/1990 | Fujiura et al. | 439/357 |

FOREIGN PATENT DOCUMENTS

| | | | |
|---|---|---|---|
| 89/05532 | 6/1989 | World Int. Prop. O. | 439/350 |

OTHER PUBLICATIONS

"Shielded Amplimite .050 Series Connectors", 2 pps AMP Incorporated 1988.

Honda Connectors '88 by Honda Tsushin Kogyo Co Ltd 15 pps.

*Primary Examiner*—Larry I. Schwartz

*Assistant Examiner*—Hien D. Vu

*Attorney, Agent, or Firm*—Roylance, Abrams, Berdo & Goodman

[57] ABSTRACT

An energy transmission cable connector having interchangeable locking mechanisms for attaching and releasably locking the connector to another device. The locking mechanisms can comprise retainers and rotatable jack screws or pivotal latches, the retainers and latches being interchangeably snap-fitted to the outer connector housing.

33 Claims, 4 Drawing Sheets

ENERGY TRANSMISSION CABLE CONNECTOR WITH INTERCHANGEABLE LOCKING MECHANISMS

FIELD OF THE INVENTION

The invention relates to an energy transmission cable connector having interchangeable locking mechanisms for attaching and releasably locking the connector to another device. The locking mechanisms can comprise rotatable jack screws or pivotal latches. The connector can be used with electrical or fiber optic cables.

BACKGROUND OF THE INVENTION

Electrical cables typically have end terminals retained in a connector housing for attachment to a complementary connector housing having mating terminals which join to complete an electric circuit. Coaxial cable demands a larger interface surface for connection than a simple cord and plug, for example, because of the higher density of end terminals.

In the past, housings for high density connectors have carried formations to facilitate connection, such as side flanges with apertures for screw type fasteners or integral hinged latches. However, in the growing field of computers and high-tech machinery, there is a demand for universally compatible accessories. Different brands or types of machines often carry different connector housings. For example, some connectors only have apertures for threaded fasteners while others only have camming prongs or fingers. In the field, the installation technician often does not know in advance what type of connectors will be encountered. Therefore, different cables and housings must be on hand or several installation trips will be required which is burdensome and costly.

Examples of prior art connectors are disclosed in the following U.S. Pat. Nos.: 3,718,887 to Solomon et al.; 4,109,989 to Snyder, Jr. et al.; 4,105,275 to Dixon et al.; 4,641,902 to Fusselman; 4,188,086 to Inouye et al.; 4,787,860 to Bender; and 4,597,624 to Lax et al.

Thus, there is a need for a versatile cable connector assembly.

SUMMARY OF THE INVENTION

Accordingly, it is a primary object of the invention to provide an energy transmission cable connector capable of adapting to a variety of connectors on other devices.

Another object of the invention is to provide a connector which can be modified easily for compatibility.

Another object of the invention is to provide a connector assembly with a reduced number of parts and therefore decreased cost.

A further object of the invention is to provide a connector with interchangeable locking mechanisms comprising rotatable jack screws or pivotal latches.

A further object of the invention is to provide a connector which is simple to make, assemble, use, and reuse.

The foregoing objects are basically attained by providing a connector, the combination comprising an energy transmission cable having a connector housing coupled thereto; an outer housing enclosing the connector housing coupled to the energy transmission cable; and a pair of locking mechanisms for locking the outer housing to another device, each of the locking mechanisms having a bore therethrough for receiving a fastener; and coupling mechanisms, coupled to the outer housing and the locking mechanisms, for removably coupling the pair of locking mechanisms to the outer housing.

The foregoing objects are also attained by providing a kit for connecting an energy transmission cable to another device, the combination comprising at least one energy transmission cable having a connector housing coupled thereto and an outer housing enclosing the connector housing, coupled to the energy transmission cable and having coupling mechanisms thereon; at least one pair of retainers for receiving fasteners, each retainer having first coupling mechanisms, engageable with the coupling mechanisms on the outer housing, for removably attaching the retainer to the outer housing; and at least one pair of pivotal latches, each latch having second coupling mechanisms, engageable with the coupling mechanisms on the outer housing, for removably attaching the latch to the outer housing, the retainers and the latches being interchangeable for connecting the cable to the other device.

Other objects, advantages and salient features of the invention will become apparent from the following detailed description which, taken in conjunction with the annexed drawings, discloses preferred embodiments of the invention.

DRAWINGS

Referring now to the drawings which form a part of this original disclosure:

DETAILED DESCRIPTION OF THE INVENTION

Figure 4:
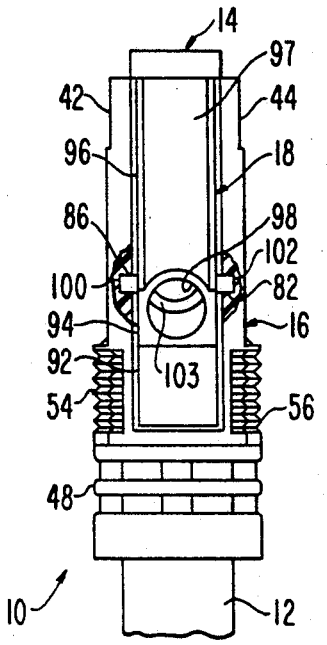
FIG. 4 is a side elevational view of the connector with retainers only of FIG. 1.
Figure 5:
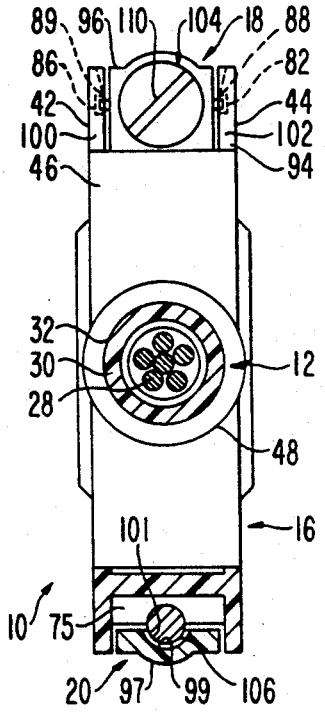
FIG. 5 is a top plan view of the connector with retainers and threaded fasteners of FIG. 1 with the cable and a portion of the housing and retainer in cross section.
Figure 6:
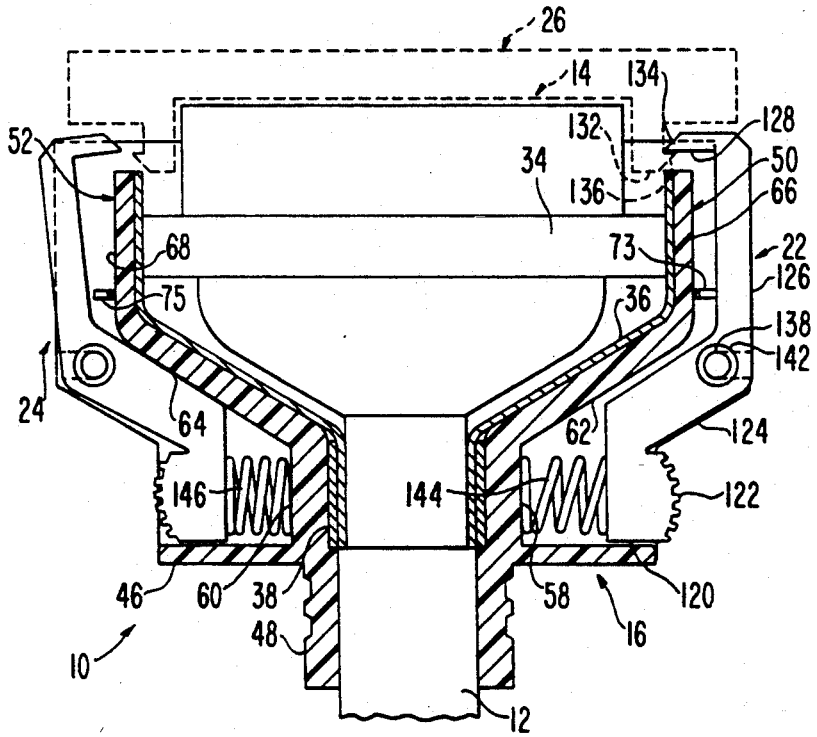
FIG. 6 is a front elevational view of the connector with pivotal latches, instead of retainers and threaded fasteners, in partial longitudinal section.
Figure 7:
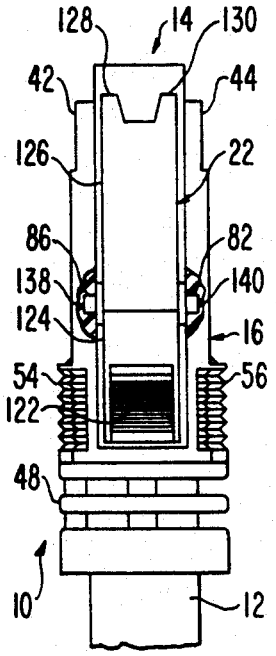
FIG. 7 is a side elevational view of the connector with pivotal latches shown in FIG. 6.
Figure 8:
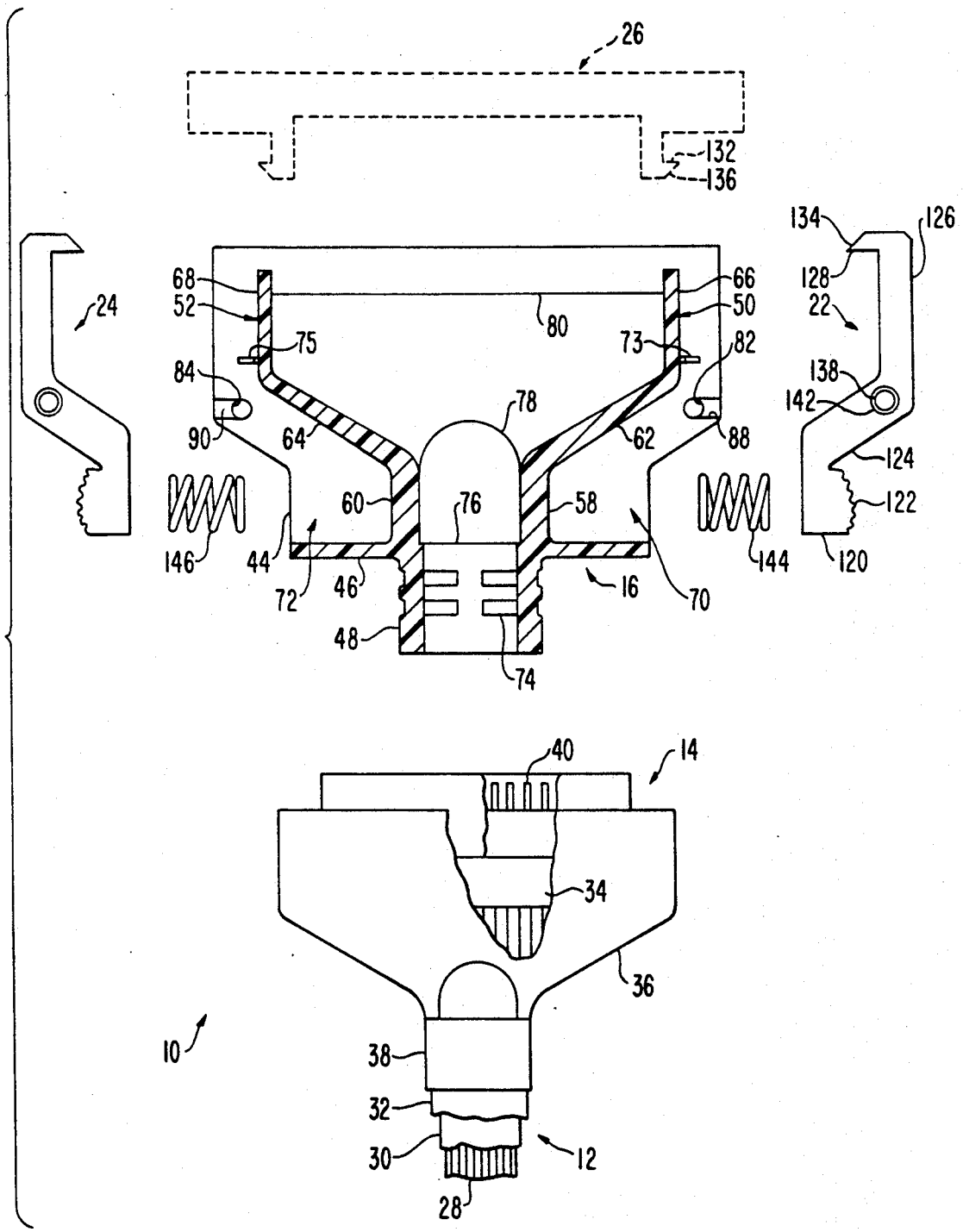
FIG. 8 is an exploded front elevational view of the connector with latches of FIG. 6 in partial longitudinal section.

As seen in FIGS. 1–8, energy transmission cable connector 10 in accordance with the invention comprises a cable 12 coupled to a connector housing 14, an outer tubular housing 16 coupled to cable 12 and housing 14, and a pair of interchangeable locking mechanisms releasably coupled to outer housing 16 In FIGS. 1–5, the locking mechanisms are rotatable and comprise retainers 18 and 20 which are coupled to outer housing 16 and jack screws 104 and 106 rotatably received in the retainers. In FIGS. 6–8, the locking mechanisms are pivotal and comprise latches 22 and 24 and springs 144 and 146, the latches being pivotally coupled to outer housing 16.

Connector 10 receives a complementary connector housing 26, shown in phantom in FIGS. 1-3, 6, and 8, for completing a circuit with either retainers 18 and 20 and jack screws 104 and 106 or latches 22 and 24 releasably locking connector 10 and complementary connector 26 together.

Figure 3:
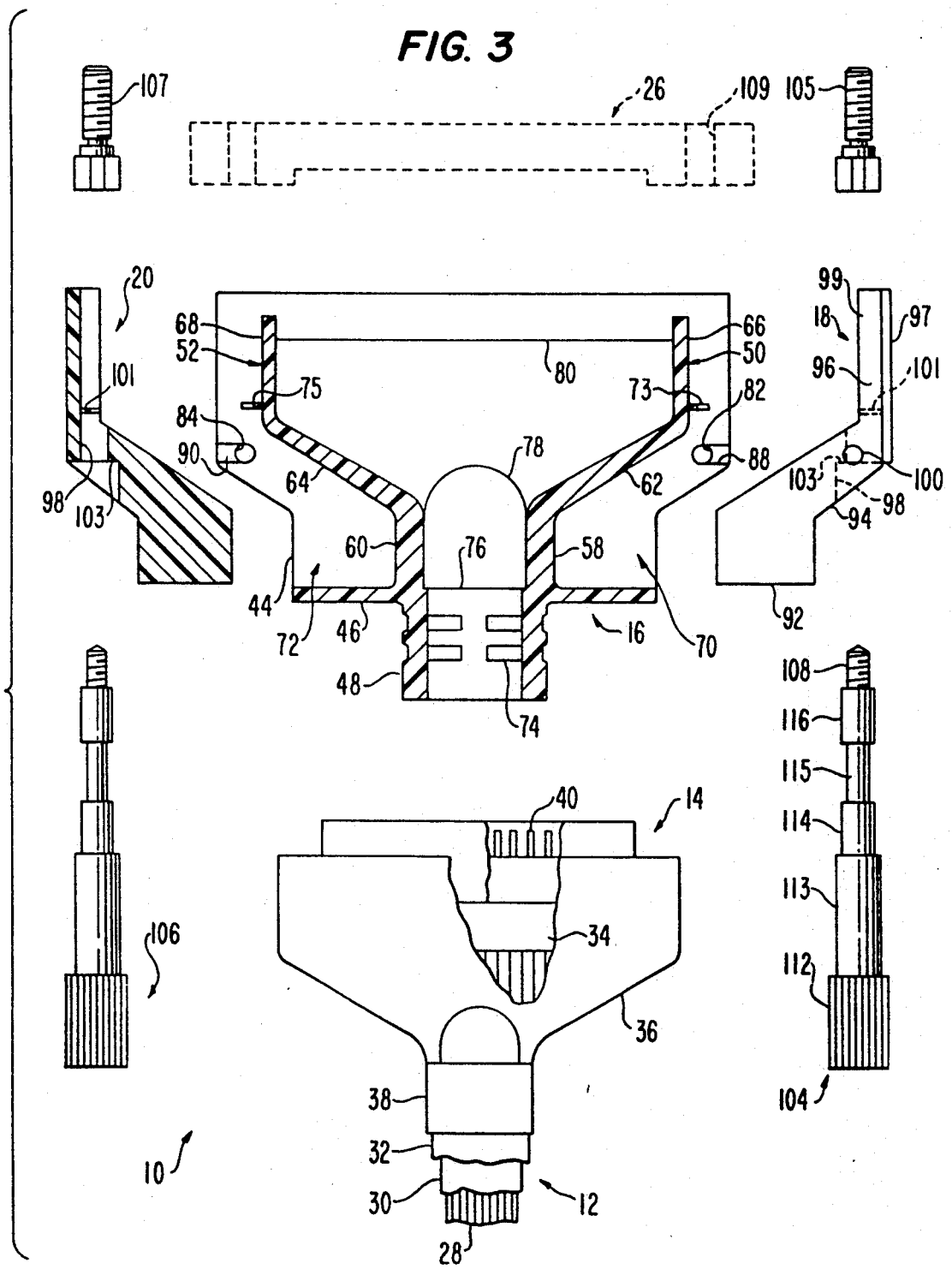
FIG. 3 is an exploded front elevational view of the connector with retainers and threaded fasteners of FIG. 1 in partial longitudinal section.

As shown in FIGS. 3 and 8, connector 10 comprises a coaxial cable 12 having a plurality of insulated conductors 28 encased by a shield layer 30 and covered by an insulated jacket 32. Cable 12 terminates in a plurality of end terminals 40 held by an insulating terminal block 34 coupled to connector housing 14. For an electrical connector, the assembly is covered by a tubular metal shield 36 electrically coupled to connector housing 14. Metal shield 36 is secured to shield layer 30 of cable 12 by an electrically conductive ferrule 38. This ferrule connection may be achieved by a crimp for mechanical strain relief and electrical conductivity. The joint may also be soldered or welded. Metal shield 36 is electrically connected to connector housing 14 by welding, soldering, or a latch mechanism. This assembly provides a transition between bound coaxial cable 12 and individual conductor terminals 40 on connector housing 14 which connect to suitable mating terminals in complementary connector housing 26 to form a circuit.

In accordance with the present invention, the above described cable 12, shield 36, ferrule 38 and connector housing 14 are enclosed by an outer tubular housing 16. Outer housing 16 is unitary, preferably substantially rigid but resilient, and integrally formed as one piece of molded material, preferably thermoplastic, such as polyvinylchloride (PVC), polyethylene, acrylonitrile butadiene styrene (ABS). or glass filled polypropylene. The material depends on the size of the housing, environmental requirements for the cable, and the economies of the overall production. Housing 16 can be molded over the cable, shield, ferrule and connector housing by a molding process such as injection molding. Alternatively, housing 16 may be preformed by molding a silhouette of the connector, slid over the cable, ferrule and metal shield, and secured by adhesive or other locking mechanisms. Both methods provide a connector with a molded, one-piece outer covering secured to the connector housing.

Figure 1:
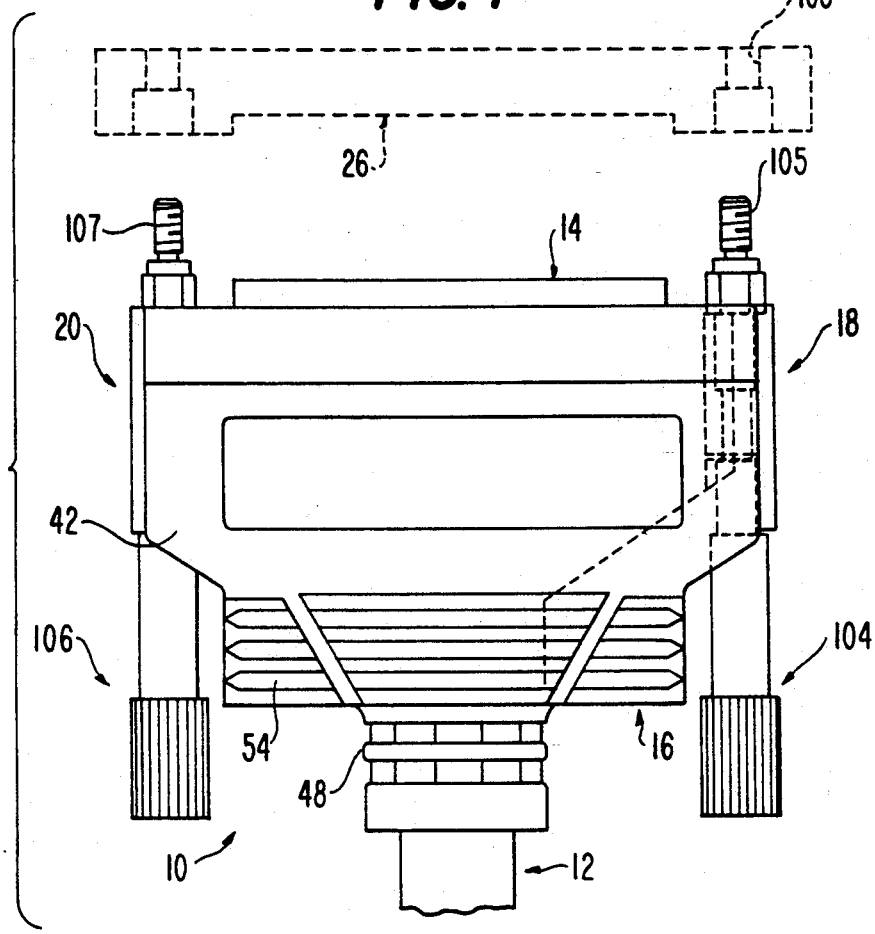
FIG. 1 is a front elevational view of the connector in accordance with the invention having rotatable locking mechanisms comprising retainers and threaded fasteners.

Outer housing 16 comprises substantially rigid but resilient planar top and bottom walls 42 and 44 which are coextensive, a planar end wall 46 having an aperture and collar 48 for receiving cable 12, and opposed substantially rigid side walls 50 and 52. Top and bottom walls 42 and 44 have gripping ridges 54 and 56 as shown in FIGS. 1, 4 and 7.

Each side wall 50 and 52 has a first planar portion 58 and 60 parallel to the longitudinal axis of housing 16, a second planar portion 62 and 64 angled at substantially 30° from the longitudinal axis, and a third planar portion 66 and 68 parallel to the longitudinal axis. Top and bottom walls 42 and 44 protrude beyond each side wall, thus forming a pair of cavities 70 and 72, each of which receives a locking mechanism best shown in FIGS. 3 and 8.

Retaining shelves 73 and 75 protrude into cavities 70 and 72 from third planar portions 66 and 68 of side walls 50 and 52, respectively. Shelves 73 and 75 are the same, each being molded with its respective side wall and extending between top and bottom walls 42 and 44. Best seen in FIG. 5, shelf 75, like shelf 73, has a generally semi-circular central cut-out.

The interior profile of housing 16 between top and bottom walls 42 and 44, side walls 50 and 52, and end wall 46 follows the outer configuration of cable 12 and shield 36. Collar 48 may be molded with interior grooves 74 to provide some flexibility. To retain ferrule 38, an interior shoulder 76 is provided which also provides strain relief to cable 12 when assembled. Metal shield 36 is retained in molded housing 16 by recess 78 and lip 80 as seen in FIG. 3. These may be formed by molding directly onto metal shield 36 assembly or by being premolded to closely fit metal shield 36. As seen clearly in FIGS. 1, 3 and 8, housing 16 provides a simple planar exterior with an open end for access to end terminals 40, while the interior conforms closely to metal shield 36, ferrule 38 and cable 12 for a secure interlock.

Each top and bottom wall 42 and 44 has a pair of opposed, coaxial cylindrical recesses formed therein which communicate with cavities 70 and 72 and form coupling mechanisms for the retainers. As seen in FIGS. 3 and 8, bottom wall 44 has recesses 82 and 84 which communicate with cavities 70 and 72 respectively. Top wall 42 has identical recesses which directly oppose those formed in bottom wall 44. For example, as seen in FIGS. 4 and 7, recess 86 in top wall 42 lies directly opposite recess 82 in bottom wall 44. As seen in FIGS. 3, 5, and 8, each recess has a generally wedge shaped, tapering sliding ramp extending from the recess to the outer edge of the respective top and bottom walls. As seen in FIGS. 3 and 8, bottom wall 44 has ramp 88 formed therein which extends from recess 82 to its outer edge and ramp 90 formed therein which extends from recess 84 to its opposed outer edge. The portion of top and bottom walls 42 and 44 shown in FIGS. 4 and 7 which contain the sliding ramps has been cut away to expose only recesses 82 and 86. Since the outer housing 16 is substantially rigid but resilient, the ramps aid in allowing a snap-fit engagement between the locking mechanisms and the housing without undue deformation of these elements.

ROTATABLE LOCKING MECHANISMS

The assembly shown in FIGS. 1 through 5 utilizes rotatable locking mechanisms comprising retainers 18 and 20 and jack screws 104 and 106. Each retainer is substantially rigid but resilient and integrally molded of one piece of material, such as that used for outer housing 16 or of other conventional material such as polyvinylchloride (PVC), polypropylene, polyethylene, or acrylonitrile butadiene styrene (ABS). The material may comprise one type of plastic, a combination of plastics, or a plastic overmolded metal core. Retainers 18 and 20 are the same. Thus, as seen best in FIGS. 2 and 3, retainer 18 has a first portion 92 which is rectangular in elevation, a second portion 94 which is trapezoidal in elevation and extends at an angle of approximately 30° from the first portion 92, and a third elongate portion 96 which extends generally parallel to first portion 92. Second portion 94 has a tubular throughbore 98 extending therethrough which has a retaining shoulder 103, best seen in reference to retainer 20 in FIG. 2, which functions as means for connecting the retainer to a complementary device. FIG. 4 shows bore 98 and retaining shoulder 103 without the threaded fastener, or jack screw, therein. As seen in FIG. 5, second portion 94 of retainer 18 and throughbore 98 extend into third portion 96. Adjacent the juncture of second portion 94 and third portion 96 of retainer 18 are a pair of coaxially aligned cylindrical protrusions 100 and 102, as seen in FIGS. 2–5, which act as coupling means. Third portion 96 has a curved exterior face 97 and an interior, generally semi-circular channel 99 extending from throughbore 98 along the length of the inside of portion 96. Channel 99 has a reduced diameter generally semi-circular retaining rim 101 disposed therein.

Each retainer 18 and 20 rotatably receives a threaded fastener 104 and 106, respectively, in its throughbore 98 for locking connector 10 to complementary connector 26 in aperture 109. Fasteners 104 and 106 are identical. Fastener 104, for example, has a first section 113, a second section 114 having a reduced diameter, a third section 115 having an even smaller diameter, a fourth section 116 having a diameter generally the same as second section 114, and a threaded end 108 for attachment to aperture 109 in connector 26. A gripping surface 112 is provided at the end opposite threads 108 to facilitate assembly and disassembly. As shown in FIG. 5, threaded fastener 104 is also provided with a tool slot 110 in its upper top surface to receive a tool for assembly and disassembly.

Auxiliary fasteners 105 and 107 are used to accommodate different size apertures 109 in connector 26. Each auxiliary fastener has an exteriorly threaded end and an interiorly threaded bore for receiving threaded end 108 of fasteners 104 and 106.

In operation, fasteners 104 and 106 are first received in central bore 98 of each retainer. Fastener 104, for example, is inserted into bore 98 and fourth section 116, being slightly larger than the constricted passage between shelf 73 and rim 101, is forced through the passage along channel 99. Third portion 115 is sized to fit freely through the constricted passage which acts as a retainer for fastener 104, allowing easy longitudinal movement only along the length of section 115. When in place, first section 113 of fastener 104 abuts shoulder 103 and second section 114 abuts rim 101 and shelf 73. Fastener 106 is installed in the same manner.

Figure 2:
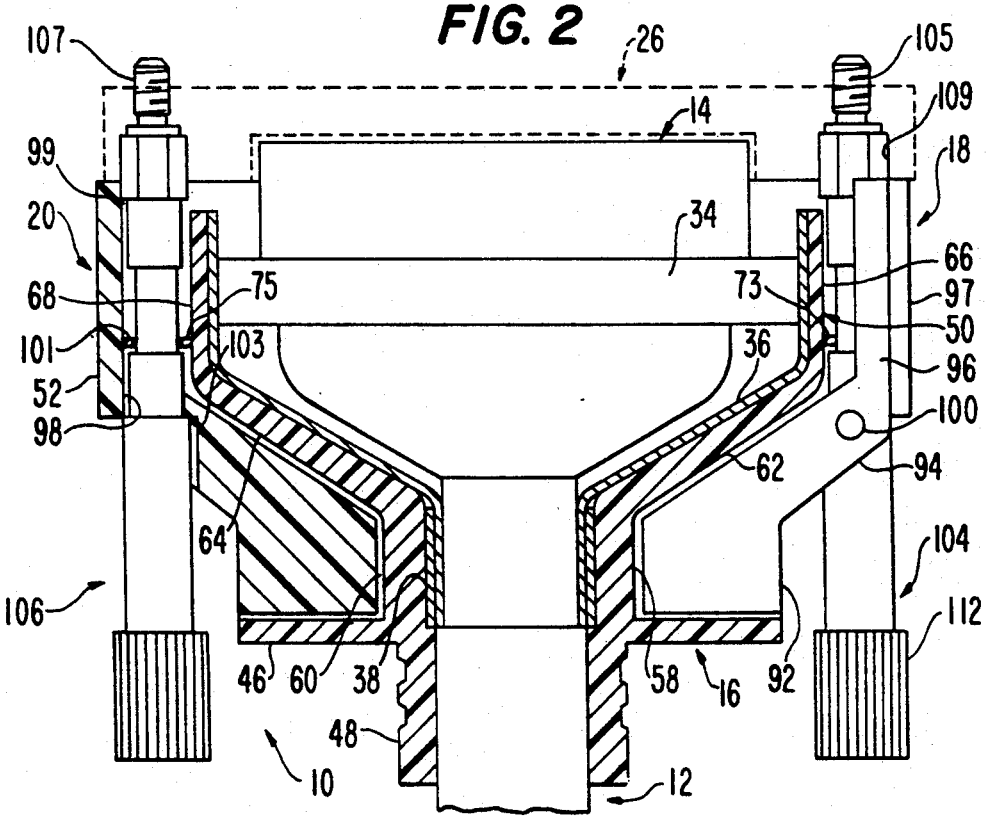
FIG. 2 is a front elevational view of the connector with retainers and threaded fasteners of FIG. 1 in partial longitudinal section.

Once fasteners 104 and 106 are inserted into their respective retainers, retainers 18 and 20 are snapped into place within cavities 70 and 72 of housing 16. FIG. 4 shows retainer 18 held in place within housing 16 with protrusions 100 and 102 retained in recesses 86 and 82, respectively. As seen in FIG. 5, retainer 18 with fastener 104, for example, is pressed into cavity 70 between top and bottom walls 42 and 44 by sliding protrusions 100 and 102 along ramps 89 and 88 until protrusions 100 and 102 are received in recesses 86 and 82. Since the retainers and outer housing are substantially rigid, the ramps allow the snap-in fit without undue deformation of these elements. As seen in FIG. 2, first portion 92 and second portion 94 of each installed retainer, 18 for example, is received closely within its respective cavity, in this case 70, while third portion 96 is spaced from third planar portion 66 of side wall 50. Channel 99 opens into each cavity with rim 101 meeting the facing cut-out in retaining shelf 73 or 75 to form a constricted circular passage.

Once retainers 18 and 20, with fasteners 104 and 106 respectively secured therein, are snapped in place, auxiliary fasteners 105 and 107 are added. Fastener 104, for example, is rotated to thread end 108 into auxiliary fastener 105. Fastener 106 is rotated in the same manner to attach auxiliary fastener 107. The assembled connector is then ready for attachment to a complementary connector 26 by rotating fasteners 104 and 106, thus threading auxiliary fasteners 105 and 107 into threaded apertures 109 of complementary connector 26.

PIVOTAL LOCKING MECHANISMS

FIGS. 6–8 show pivotal locking mechanisms comprising latches 22 and 24 used with outer housing 16 rather than retainers 18 and 20 and jack screws 104 and 106 of FIGS. 1–5. Latches 22 and 24 are substantially rigid and also formed as one piece of molded material which may be the same as the outer housing or may be conventional materials such as polyvinylchloride (PVC), polypropylene, polyethylene, or acrylonitrile butadiene styrene (ABS). Again, the latches may comprise one type of plastic, a combination of two or more multi-cycle molded types of plastic, or a plastic overmolded metal core. In FIGS. 6–8, latches 22 and 24 are the same. Thus, latch 22 comprises an elongate member having a first straight portion 120 with an outer curved pressing surface 122 which may be textured for ease of gripping, a second angled portion 124 which angles and flares away from first portion 120 at about 30°, and a third generally straight portion 126 which extends substantially parallel to first portion 120. Third portion 126 has a pair of locking fingers 128 and 130 as means for connecting or engaging a suitable locking finger 132 on complementary connector housing 26. Locking fingers 128 and 130 are the same, and each has a camming surface 134 to allow a snap fit or sliding fit with a similar camming surface 136 on complementary connector housing 26.

Each latch, 22 for example, has a pair of coaxial cylindrical protrusions, or rods, 138 and 140, integrally formed with the latch and located adjacent the juncture of second portion 124 and third portion 126 which act as coupling means. Surrounding each protrusion, 138 for example, is an integrally formed washer 142, shown in FIGS. 6 and 8.

Latches 22 and 24 are used with helical compression springs 144 and 146 which are identical. Alternatively, latches 22 and 24 may be formed with an integral leaf spring configured as an arcuate extension. The integral leaf spring extends from the second portion 94, behind and away from the first portion 120 of each latch. Both the helical and integral leaf springs are located in the respective cavities of housing 16 and are arranged to bear on the first portion 58, for example, of side wall 50 when the latches are in an open, unlocked position.

In operation, spring 144 is first placed within cavity 70 of outer housing 16. Latch 22 is then snapped in place within cavity 70 by sliding protrusions 138 and 140 up ramps 89 and 88 and into recesses 86 and 82, where they are pivotally received. The opposed ramps allow the latch to slide between top and bottom walls 42 and 44 of housing 16 and snap into the corresponding opposed recesses without undue deformation of the protrusions. As shown in FIG. 6 once the latches are in place within the cavity, protrusions 138 and 140, for example, provide a pivot axis or joint for latch 22 to move between a closed locked position as shown in the right hand portion of the figure and an open unlocked position as shown in the left hand portion of the figure. Second planar portion 62 and shelf 73 on third planar portion 66 of side wall 50 provide bearing surfaces which limit the range of motion of pivotal latch 22. Spring 144 provides the biasing force to hold latch 22 in the locked position. When force is applied to pressing surface 122 of latch 22, spring 144 is compressed and latch 22 pivots into an open position. The stiffness of the spring may be varied depending on the desired ease or difficulty in pressing the latch. Latch 24 is snapped into cavity 72 with spring 146 in the same manner.

Locking finger 128 of latch 22 retains a similar locking finger 132 of complementary connector housing 26 in the locked position. Camming surface 134 slides against camming surface 136 of complementary connector 26 for a snap fit connection. It is also possible to provide spring 144 with a tension that allows the pressing of surface 132 of complementary connector 26 against camming surface 134 of latch 22 to force latch 22 to pivot and compress spring 144. Latch 24 and spring 146 work identically to latch 22 and spring 144 discussed above.

Kit

To accommodate various types of complementary connectors, i.e., those having either a threaded aperture or locking fingers, a kit in accordance with the present invention is provided having interchangeable retainers 18 and 20 and latches 22 and 24 for use with either jack screws 104 and 106 or springs 144 and 146. Thus, outer housing 16 can interchangeably receive either retainers or latches since the dimensions and configurations of the cavities 70 and 72 are formed to coordinate with and suitably receive either the retainers or latches. In the field, an installer has a cable 12 with connector housing 14 and outer housing 16, a set of retainers 18 and 20 and fasteners 104 and 106, and a set of latches 22 and 24 and compression springs 144 and 146. Alternatively, latches 22 and 24 may have integral leaf springs and therefore no additional compression springs would be needed. Thus, when a complementary connector 26 having a threaded aperture is encountered, retainers 18 and 20 carrying fasteners 104 and 106 are snapped into housing 16, and the fasteners threadedly fasten complementary connector 26 to connector 10 according to the present invention. Alternatively, when a complementary connector 26 is encountered having locking fingers, latches 22 and 24 are snapped into housing 16 for pivotal locking attachment to the complementary connector 26. If the complementary connector 26 is configured to receive either locking fingers or threaded fasteners, the installer then has the choice of using either the pivotal latches or retainers and rotatable jack screws, depending on the desired function of the system. After installation, if the hardware of the complementary connector 26 is changed, it is also possible to change between retainers and screws and latches by snapping one or the locking mechanisms out of cavities 70 and 72 and replacing it with the other. This requires a slight outward deformation of the top and bottom walls. The removability of latches and retainers also facilitate quick repair on site by an unskilled technician.

Connector 10 according to this invention may be modified in size by adjusting the length and/or width to accommodate connectors within the range of, but not limited to, 20 to 120 positions.

The present invention relates to a connector for an electrical cable which transmits power, data, signals, or voice. However, the invention broadly encompasses a connector for any type of cable used for energy transmission such as a fiber optic cable, an electrical cable, or a combination of both fiber optic and electrical conductors in a cable or cables.

While advantageous embodiments have been chosen to illustrate the invention, it will be understood by those skilled in the art that various changes and modifications can be made therein without departing from the scope of the invention as defined in the appended claims.

What is claimed is:

1. A connector, the combination comprising:

an energy transmission cable having a connector housing coupled thereto;

an outer housing enclosing said connector housing and coupled to said energy transmission cable;

a pair of locking means for locking said outer housing to another device, each of said locking means having a bore therethrough for receiving a fastener; and coupling means, coupled to said outer housing and said pair of locking means, for removably coupling said pair of locking means to said outer housing, said outer housing having a longitudinal axis and a pair of cavities, each of said cavities being laterally-facing and outwardly-opening, and adapted to receive one of said locking means therein upon sliding of said locking means in the lateral direction substantially perpendicular to said longitudinal axis.

2. A connector according to claim 1, wherein said outer housing is unitary.

3. A connector according to claim 1, wherein said coupling means includes a pair of coaxial protrusions formed on each one of said pair of locking means; and two pairs of recesses formed on said outer housing, each of said recesses receiving one of said protrusions in snap-fit engagement.

4. A connector according to claim 1, wherein said outer housing comprises molded thermoplastic material.

5. A connector according to claim 1, and further comprising a shield connected to said connector housing and said cable, said outer housing being integrally molded around said shield.

6. A connector according to claim 1, and further comprising a pair of fasteners, each of said fasteners having a reduced diameter portion.

7. A connector according to claim 1, wherein said outer housing is tubular and comprises a planar top wall having outer edges;

a planar bottom wall having outer edges coextensive with said outer edges of said top wall;

said outer housing longitudinal axis being parallel to said top and bottom walls;

a planar end wall coupled to said top and bottom walls and having an aperture for receiving said cable; and a pair of side walls joining said top and bottom walls;

each of said cavities being bounded by at least a portion of one of said side walls and a portion of said top wall and a portion of said bottom wall.

8. A connector according to claim 7, wherein each of said side walls comprises a first planar portion substantially parallel to said longitudinal axis;

a second planar portion extending from said first portion and angled substantially 30° from said longitudinal axis; and a third planar portion extending from said second portion substantially parallel to said longitudinal axis.

9. A connector according to claim 7, wherein each of said cavities has a retaining shelf extending between said top and bottom walls and from said side wall, said shelf having a generally semi-circular cut-out.

10. A connector according to claim 7, wherein each of said portions of said top wall bounding each of said cavities has a recess formed therein; and each of said portions of said bottom wall bounding each of said cavities has a recess formed therein opposed and coaxial with one of said recesses formed in said top wall.

11. A connector according to claim 10, and further comprising a sliding ramp extending from each of said recesses to said outer edges of said top and bottom walls.

12. A connector according to claim 1, wherein each of said locking means comprises a retainer having a first portion;

a second portion extending substantially 30° from said first portion; and a third elongate longitudinal portion extending from said second portion substantially parallel to and away from said first portion.

13. A connector according to claim 12, wherein said second portion has said bore extending therethrough for receiving a fastener.

14. A connector according to claim 13, wherein said bore has a shoulder for restraining said fastener received therein.

15. A connector according to claim 12, wherein each of said retainers has a pair of coaxial protrusions extending therefrom and located adjacent the juncture of said second and third portions.

16. A connector according to claim 12, wherein each of said cavities receives one of said retainers and is complementarily shaped to said one of said retainers received therein.

17. A connector according to claim 12, wherein said third portion has a curved exterior face and a generally semi-circular interior channel for receiving a fastener.

18. A connector according to claim 17, wherein said interior channel has a retainer rim therein.

19. A kit for connecting an energy transmission cable to another device, comprising:

at least one energy transmission cable having a connector housing coupled thereto, and an outer housing enclosing said connector housing coupled to said energy transmission cable and having coupling means thereon;

at least one pair of retainers for receiving fasteners, each retainer having first coupling means, engageable with said coupling means on said outer housing, for removably attaching said retainer to said outer housing; and at least one pair of pivotal latches, each latch having second coupling means, engageable with said coupling means on said outer housing, for removably attaching said latch to said outer housing, said retainers and said latches being interchangeable for connecting said cable to the other device, said outer housing having a longitudinal axis and a pair of cavities, each of said cavities being laterally-facing and outwardly-opening, and adapted to receive one of said retainers or pivotal latches therein upon sliding of said retainer or pivotal latch in the lateral direction substantially perpendicular to said longitudinal axis.

20. A kit according to claim 19, and further comprising at least one pair of springs.

21. A kit according to claim 20, wherein said springs are helical compression springs.

22. A kit according to claim 19, wherein said first and second coupling means each comprises a pair of coaxial protrusions.

23. A kit according to claim 19, wherein each of said latches comprises at least one locking finger for gripping the other device; and biasing means for biasing said latch into the locked position, said biasing means being spaced from said second coupling means, said second coupling means being a pivotal joint.

24. A kit according to claim 19, wherein said outer housing is unitary.

25. A kit according to claim 19, and further comprising at least one pair of fasteners.

26. A kit according to claim 25, wherein said fasteners are threaded.

27. A kit according to claim 19, wherein each of said retainers and said latches comprises a first portion;

a second portion extending from said first portion at approximately 30°; and a third elongate portion extending from said second portion substantially parallel to said first portion, said first and second coupling means being located adjacent the juncture of said second and third portions of said retainer and said latch respectively, said third portion having connecting means for connecting to the other device.

28. A kit according to claim 27, wherein said connecting means on each of said retainers comprises a bore for receiving a fastener.

29. A kit according to claim 27, wherein said connecting means on each of said latches comprises at least one locking finger with a camming surface.

30. A kit according to claim 19, wherein said outer housing is tubular and comprises a planar top wall having outer edges;

a planar bottom wall having outer edges, coextensive with said outer edges of said top wall;

said outer housing longitudinal axis being parallel to said top and bottom walls;

a planar end wall coupled to said top and bottom walls and having an aperture for receiving said cable; and a pair of side walls joining said top and bottom walls;

each of said cavities being bounded by at least a portion of one of said side walls and a portion of said top wall and a portion of said bottom wall.

31. A kit according to claim 30, wherein said coupling means on said outer housing includes a recess formed in each of said portions of said top wall bounding each of said cavities; and a recess formed in each of said portions of said bottom wall bounding each of said cavities and opposed and coaxial with said recess formed in said top wall.

32. A kit according to claim 31, wherein said coupling means on said outer housing further includes a sliding ramp extending from each of said recesses to said outer edges of said top and bottom walls.

33. A kit according to claim 31, wherein said first or second coupling means is received in said recesses in snap-fit engagement.

* * * * *